US006295427B1

(12) United States Patent
Flick et al.

(10) Patent No.: US 6,295,427 B1
(45) Date of Patent: Sep. 25, 2001

(54) PROTECTIVE CONTAINER/INSTALLATION FIXTURE FOR IMAGE-RECORDING/IMAGE-TRANSFER DRUMS

(75) Inventors: James Raymond Flick, Rochester; Dennis James Grabb, Sodus; Donald Calvin Buch, Penfield, all of NY (US)

(73) Assignee: Nex Press Solutions LLC, Rochester, NY (US)

( * ) Notice: Subject to any disclaimer, the term of this patent is extended or adjusted under 35 U.S.C. 154(b) by 0 days.

(21) Appl. No.: 09/473,417

(22) Filed: Dec. 29, 1999

(51) Int. Cl.[7] ..... G03G 15/02
(52) U.S. Cl. ..... 399/116; 399/121
(58) Field of Search ..... 399/108, 116, 399/117, 121, 302, 303, 308; 312/9.3, 9.4, 9.8, 72, 334.7, 334.8; 206/15, 446

(56) References Cited

U.S. PATENT DOCUMENTS 4,253,758 * 3/1981 Cormier ..... 399/116
4,376,579 * 3/1983 Wakao ..... 399/117
4,766,455 * 8/1988 Carter ..... 399/116
4,823,160 * 4/1989 Ikuta et al. ..... 399/117
5,313,255 * 5/1994 Taniguchi et al. ..... 399/117
5,745,825 * 4/1998 Okawa et al. ..... 399/117
6,052,548 * 4/2000 Yamamoto ..... 399/116
6,058,280 * 5/2000 Kumar et al. ..... 399/117

* cited by examiner

*Primary Examiner*—Robert Beatty
(74) *Attorney, Agent, or Firm*—Lawrence P. Kessler

(57) ABSTRACT

A protective enclosure for an image-recording drum of the type used in electrophotographic printer/copiers comprises a pair of spaced guides that serve to slidably support the drum within the enclosure. Such guides, when aligned with similar drum guides located within a printer/copier frame, enable the drum to be transferred from the enclosure to the copier/printer by merely sliding the drum from one pair of drum guides to the other. A mounting mechanism operates to couple the drum enclosure with the printer/copier frame to properly align the respective drum guides. By virtue of the invention, the image-recording drum can be installed in copier/printer without physically contacting the drum's delicate photosensitive surface, thereby eliminating any image artifacts that may arise from inadvertent scratching or marring of the drum surface during installation.

7 Claims, 6 Drawing Sheets

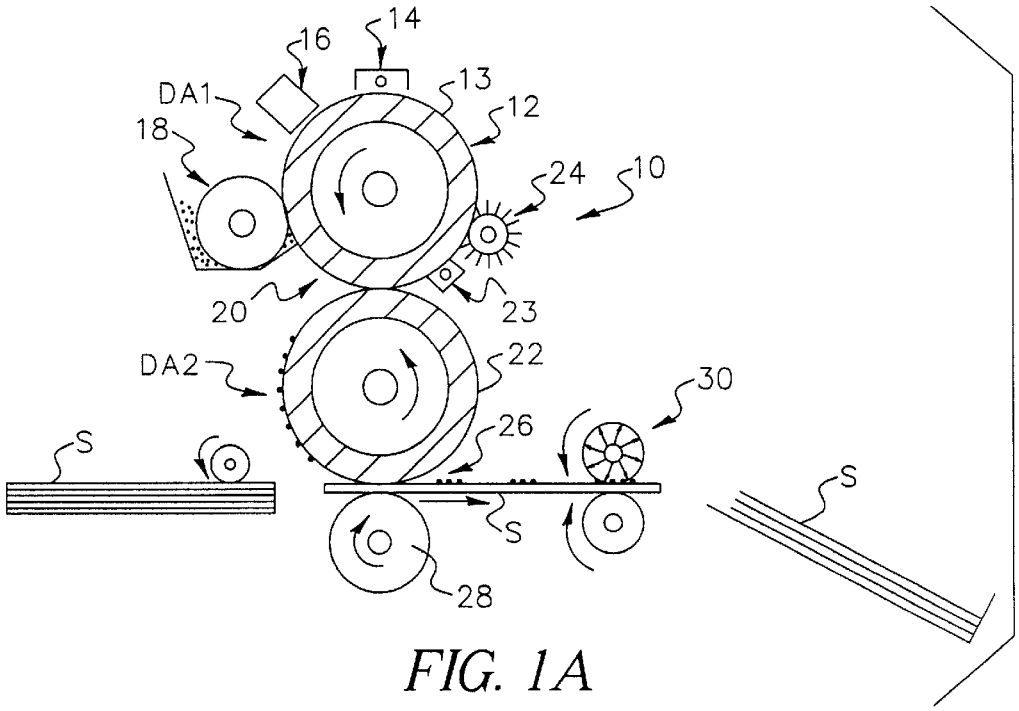
FIG. 1A
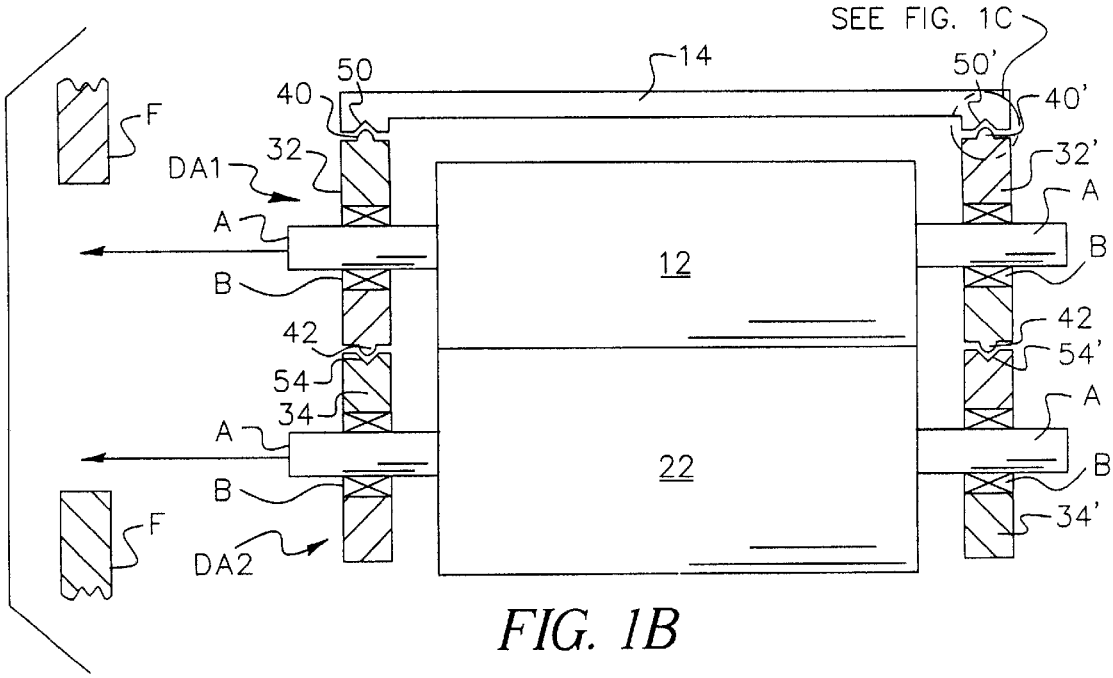
FIG. 1B
FIG. 1C
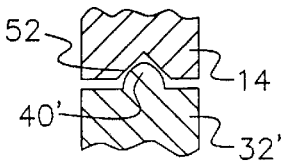

PROTECTIVE CONTAINER/INSTALLATION FIXTURE FOR IMAGE-RECORDING/IMAGE-TRANSFER DRUMS

CROSS-REFERENCE TO RELATED APPLICATIONS

Reference is made to the commonly assigned U.S. patent application Ser. No. 09/474,352, filed concurrently herewith and entitled"Apparatus for Positioning Image Processing Stations in a Document Printer/Copier".

FIELD OF THE INVENTION

The present invention relates to improvements in apparatus and methods for protecting image-recording and/or image-transfer drums during shipping, handling and installation into an electrophotographic printer/copier or the like.

BACKGROUND OF THE INVENTION

The image recording element used to record images in an electrophotographic printer/copier is often in the form of a cylindrical drum having a photoconductive outer surface. In a well-known manner, transferable visible images are formed on the drum's photoconductive surface by rotating the drum about its central axis so as to advance the photoconductive surface past the various image-processing stations that carry out the electrophotographic process. These stations typically include a corona charging station for uniformly sensitizing the drum surface with electrostatic charges; an exposure station for imagewise exposing the charged surface with actinic radiation to selectively dissipate the uniform charge, leaving behind a latent electrostatic charge image; and a development station for applying electroscopic toner to the charge image to render it visible. The toner image thus formed is then transferred to an image-receiver sheet (e.g., a sheet of plain paper) so that the drum surface can be recycled through the image-forming process to produce multiple copies or prints. Transfer of the toner image can be made either directly to the image-receiver sheet, or indirectly to the image-receiver sheet via an intermediate image-transfer drum, e.g., a plastic-coated drum, to which the toner image is first transferred before being transferred again to the image-receiving sheet. Following image transfer, one or more cleaning stations operate to remove any residual toner from the drum surface(s).

As will be appreciated, the operative outer surfaces of image-recording and image-transfer drums of the above type are relatively delicate in nature. Virtually any scratch, mark, gouge or the like on the drum surface is likely to give rise to an artifact in the toner image formed thereon. Thus, from the time of drum manufacture until the time a drum is eventually installed in its host printer/copier, substantial care must be taken to guard against, or at least minimize, any physical contact with the drum's sensitive outer surface. Typically, image-recording drums are shipped from the manufacturer in a sealed, light-tight container or box in which the drum is supported, e.g., at its edges or by opposing axles, so that its' photoconductive surface is spaced from all surfaces within the container. The container may be fitted with yokes or the like for supporting the drum axles.

To facilitate drum installation while guarding against any deleterious contact with the drum's photoconductive surface, it is common to movably mount most, if not all, of the various image-processing stations of the printer/copier for movement between their operative position and a clearance position. In their respective operative positions, each processing station is either in contact with, or in close proximity to, the path traversed by the drum surface so that the station can act upon the drum surface in carrying out its intended function. In their respective clearance positions, the processing stations are substantially spaced from the drum path, perhaps by as much as 30 mm. This spacing is intended to provide ample room for the drum-installing technician to maneuver or slide the drum axially, e.g., towards and away from its operative position, without making any contact with the internal components of the processing stations. This need for ample spacing can have a significant effect on the overall size of the printer/copier, making it somewhat larger than it theoretically need be. Ideally, the minimum clearance spacing required to install or replace a drum is slightly more than that required to free the drum from physical contact with those processing stations that need to contact the drum surface to carryout their respective functions, e.g., the development, cleaning, and image-transfer stations. But using this minimum spacing in the design of a printer/copier is apt to jeopardize the integrity of the drum surface during drum installation and removal. Moreover, it increases the technician skill level required to effect these operations.

In U.S. Pat. No. 4,823,160 issued to Ikuta et al., apparatus is disclosed for facilitating the loading and unloading of a photosensitive drum in an electrophotographic printer or copier. The design of this loading/unloading apparatus presupposes that the drum comprises a replaceable photosensitive outer sleeve that is supported by an inner cylindrical member mounted on a drive shaft. The cylindrical support member is part of the printer/copier and is not itself replaceable with the photoconductive sleeve. One end of the drive shaft is secured to the rear wall of the printer/copier frame, and the cylindrical support member is slidably mounted on the drive shaft. Thus, to replace the photoconductive surface of the drum, the cylindrical support member is slided along the drive shaft until a major portion of such member clears the front wall of the machine. Thereafter, the photoconductive sleeve is removed by sliding it axially off the free end of the cylindrical support member. While this apparatus may be useful in minimizing the aforementioned clearance space required to install a drum amid the various image-processing stations of an electrophotographic printer/copier, it does not address the problem of minimizing contact with the photoconductive surface by the drum-installing technician. Here, the technician must physically handle the photoconductive sleeve in placing it on the cylindrical support member. Further, as mentioned, the apparatus is useful with a drum assembly in which only the photoconductive sleeve is replaceable, not one in which the entire assembly, including the sleeve-supporting structure, is replaceable.

SUMMARY OF THE INVENTION

In view of the foregoing discussion, an object of this invention is to provide an improved protective container for image-recording and/or image-transfer drums of the type described above, a container that is improved at least from the standpoint that it not only serves to protect the drum surface from exposure and contact during storage, shipment, and handling, but also serves to facilitate a drum installation process in which no contact whatsoever is to be made with drum's delicate outer surface, either by the installing technician, or by any image-processing stations that are minimally spaced from the drum path.

Another object of this invention is to provide a system for transferring an image-recording drum from a protective container to an operative position within a printer/copier without physically contacting the drum's photosensitive surface.

Still another object of this invention is to provide an improved method for installing image-recording and/or image-transfer drums in electrophotographic printer/copiers.

According to one aspect of this invention, an improved drum container is provided for use in protecting a drum assembly of the type that includes (i) a drum having a pair of axles extending outwardly from opposing ends of the drum along a desired axis of rotation and (ii) a pair of spaced support members for rotatably supporting the drum therebetween. Each support member has a bearing located in a central region thereof for rotatably supporting one of the drum axles, and at least one outwardly extending drum-support legs adapted to slidably engage an elongated, rectilinear channel defined by a drum assembly-guide mounted within a drum-utilization device (e.g., an electrophotographic printer) for guiding the drum assembly to a desired position within a frame of such device while supporting such assembly in a position spaced from all internal surfaces of the utilization device. The drum container of the invention basically comprises: (a) a frame for housing a drum assembly of the type described; and (b) at least one rectilinear guide member mounted within such frame, such guide member defining a channel adapted to receive the respective drum-support legs of the drum-support members and to slidably support the drum assembly within the container so that the drum's outer surface is out of contact with any surface of the container. Preferably, the drum container further comprises mounting means, cooperative with mounting means on the frame of the drum utilization device, for selectively mounting the container on the drum-utilization device in a position in which the container guide is aligned and in communication with the rectilinear guide of the drum-utilization device. In this position, the drum assembly can be readily transferred from said container to the drum-utilization device by sliding said rigid drum-support legs along the container channel and into the rectilinear channel of the utilization device until the drum assembly reaches its operative position within the utilization device.

According to another aspect of this invention, a new system is provided for installing an image-recording and/or image-transfer drum in a printer/copier. Such system comprises: (a) first support means for slidably supporting a drum for movement along a first rectilinear path within a drum container; (b) second support means for slidably supporting a drum for movement along a second rectilinear path within a printer/copier frame between a drum-receiving position and an operative position; and (c) mounting means for selectively mounting the container on the printer/copier so that said first and second rectilinear paths are co-linear and in communication, whereby the drum is slidably transferable from the drum container to said operative position in the printer/copier by sliding movement along such paths.

According to a third aspect of this invention, a new method for installing an image-recording drum into an operative position within a printer/copier comprises the steps of: (a) providing a drum container of the type comprising at least one rectilinear guide for supporting a drum for sliding movement within the container in a direction substantially parallel to the drum's axis of rotation; (b) slidably mounting an image-recording drum within said container in said rectilinear guide; (c) providing at least one rectilinear drum guide within a printer/copier for slidably supporting a drum for rectilinear movement towards and away from an operative position; (d) positioning the drum container relative to the printer/copier so that their respective rectilinear guides are aligned and in contact; and (e) sliding the drum along the container's rectilinear guide and into the rectilinear guide of the printer/copier.

An advantageous technical effect of the invention is that a drum of the type described can, upon being placed in the container of the invention by the manufacturer, arrive at its final destination within the frame of a utilization device with no contact ever being made with the drum's outer surface. This effect is owed to the fact that the drum's protective container operates both as a protector of the drum as well as a fixture for loading or transferring the drum into its utilization device.

The invention and its advantages will be better understood from the ensuing detailed description of preferred embodiments, reference being made to the attached drawings in which like reference characters denote like parts.

BRIEF DESCRIPTION OF THE DRAWINGS

FIGS. 1A and 1B are schematic side and front elevations of an electrophotographic printer illustrating a pair of drum assemblies of the type that are intended to be housed in the drum container of the invention;

FIG. 1C is an enlarged view of a portion of the apparatus shown in FIG. 1B;

DETAILED DESCRIPTION OF THE INVENTION

Figure 2A:
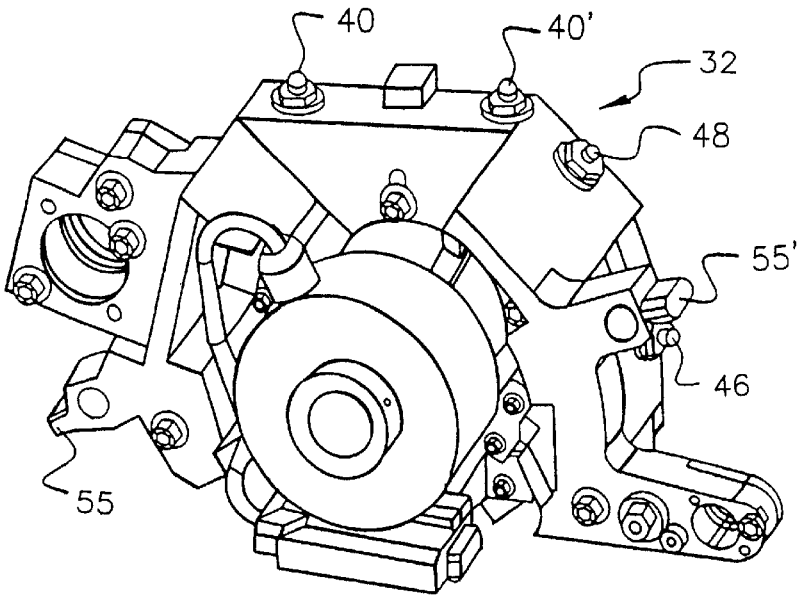
FIGS. 2A–2D are isometric drawings of a pair of drum support members serving to rotatably support an image-recording drum in an electrophotographic printer.

Referring now to the drawings, FIGS. 1A and 1B schematically illustrate an electrophotographic printer 10 embodying two drum assemblies DA1, DA2, of the type that are useful with the drum container of the invention. One drum assembly comprises an image-recording drum 12 having a photoconductive outer layer 13 on which toner images are formed in a conventional manner. Drum 12 is rotatably driven by any suitable mechanism for rotation indicated by the arrow. The other drum assembly comprises an intermediate image-transfer drum 22 having an adhesive polymeric surface to which toner images formed on the image-recording drum are transferred prior to being re-transferred to a receiver sheet S. In brief, printer 10 comprises a corona charger 14 for uniformly charging the photoconductive surface of drum 12, a print head 16 for imagewise exposing the charged photoconductor, line-by-line, to form a charge image, and a development station 18 for developing the charge image with toner particles. At a first transfer nip 20, the toner image thus formed is transferred to the image-transfer drum 22. Residual toner is removed from drum 12 by a cleaning station comprising a pre-clean corona charger 23 and a cleaning brush 24. The toner image transferred to the intermediate transfer drum 22 is then re-transferred to receiver sheet S at a second transfer nip 26 formed at the region of contact between a pressure roller 28 and drum 22. A fusing station 30 serves to fuse the toner image to the receiver sheet. Each processing station (except for the print head) is mounted for slight movement (e.g. about 5 mm.) towards and away from its respective operative position adjacent the drum surface to provide minimal clearance for installation and replacement of the drum assembly. During such installation, the drum assembly is moved substantially parallel to drum's axis of rotation, in the direction of the arrows, through an opening in the machine frame F.

As shown in FIG. 1B, the respective drums 12 and 22 of the drum assemblies DA1 and DA2 are supported for rotation by a pair of drum-support members, 32,32' and 34,34' respectively. Each drum-support member comprises a centrally located bearing B adapted to support a drum axle A for rotation. Extending outwardly from each drum-support member is a plurality of reference features adapted to cooperate with corresponding reference features on each of the image-processing stations for the purpose of precisely locating each processing station in an operative position relative to the drum surface. Such a scheme for locating the processing stations relative to the drum surface is disclosed in the above-referenced U.S. patent application Ser. No. 09/474,352, and the disclosure of this application is hereby incorporated herein by reference. For example, referring to FIG. 1B, each of the drum-support members 32 and 32' is provided with a pair of bullet-shaped reference features 40,40' which cooperate V-shaped grooves 50 and 50' respectively carried by opposing ends of the charging station 14 (and better shown in FIG. 1C) for precisely positioning the high voltage grid of the corona charger 14 parallel to the drum's photoconductive surface. Further, the drum-support members 32 and 32' carry outwardly extending reference features 44 and 44', respectively, for precisely positioning the intermediate transfer drum 22 relative to the surface of drum 12. As shown in FIG. 1B, reference features 44 and 44' cooperate with V-shaped 54 and 54' provided on the drum supports 34 and 34' of drum assembly DA2.

Figure 2B:
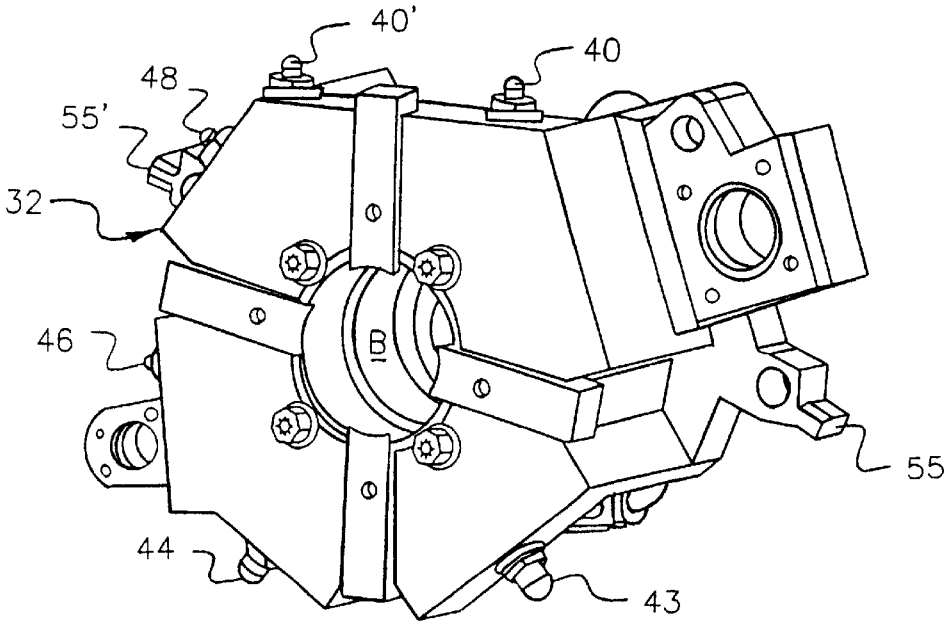
Figure 2C:
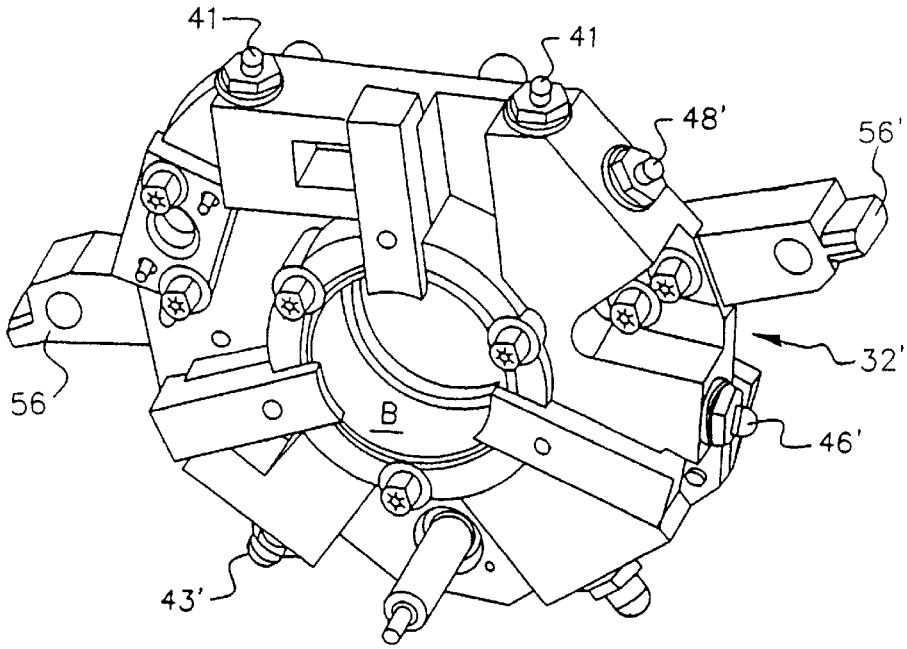
Figure 2D:
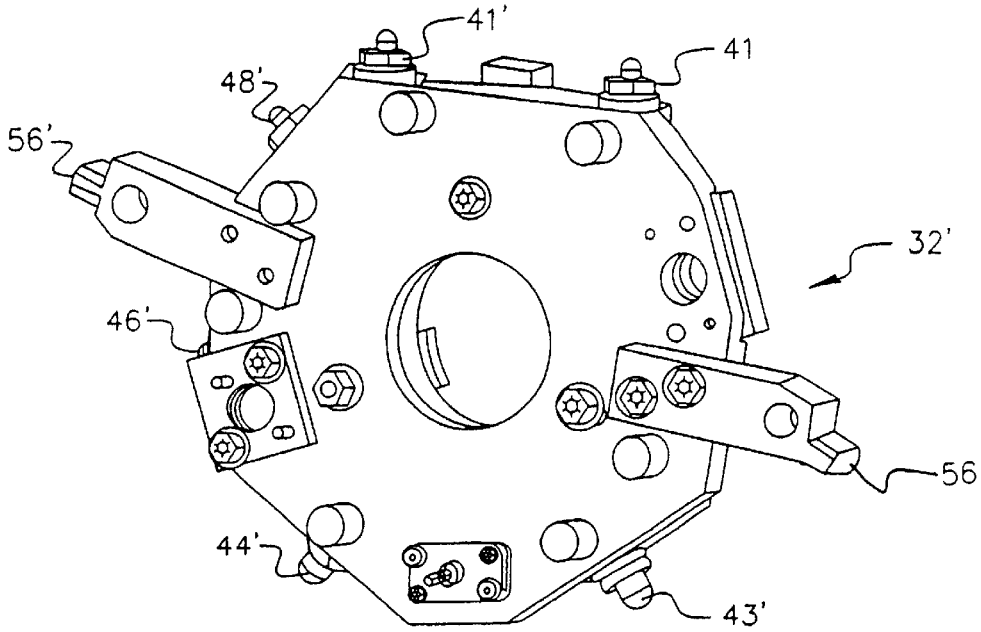

In FIGS. 2A–2D, preferred structural details of the above-noted drum-support members are shown. FIGS. 2A and 2B are isometric front and rear views of the front drum-support member 32, and FIGS. 2C and 2D are isometric front and rear views of the rear drum-support member 32'. A pair of bullet-shaped reference features 40 and 41 on drum-support member 32 cooperate with features 40' and 41' on drum-support member 32' to position the corona charging station 14. Similarly, features 43 and 43' serve to position the development station 18; features 44 and 44' serve to position the intermediate transfer drum 22; features 46 and 46' serve to position the pre-clean corona charger 23; and features 48 and 48' serve to position the cleaning brush 24.

Figure 3A:
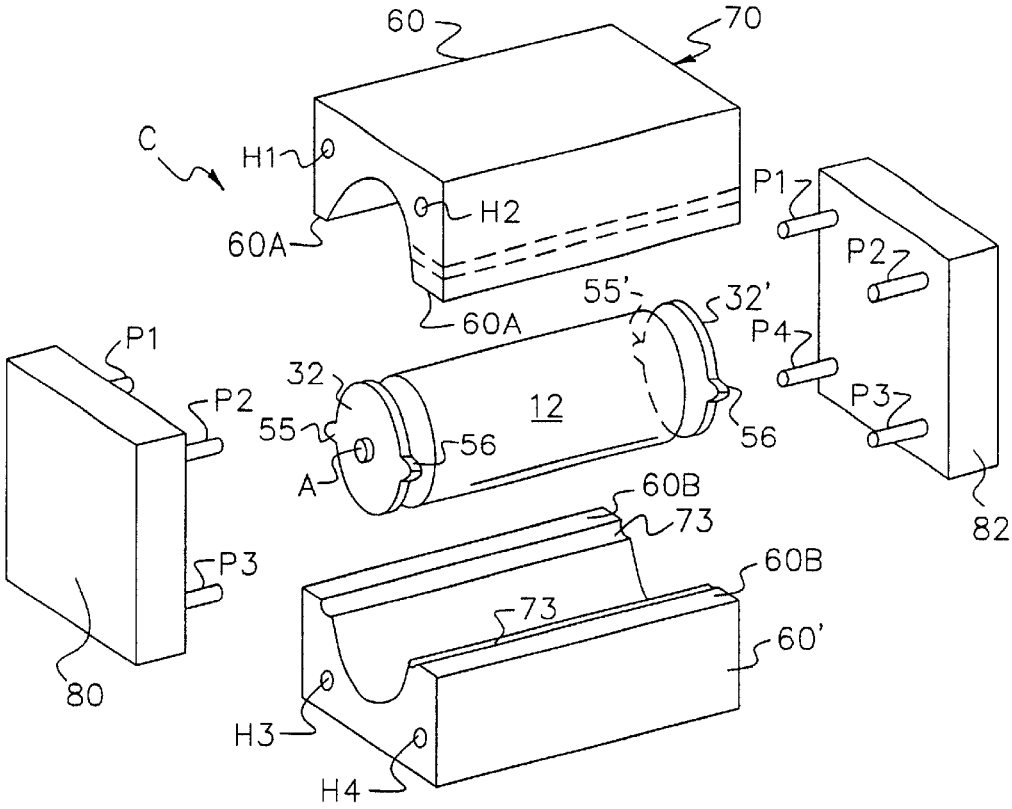
FIGS. 3A and 3B are exploded and cross-sectional illustrations of a drum container embodying the present invention.
Figure 3B:
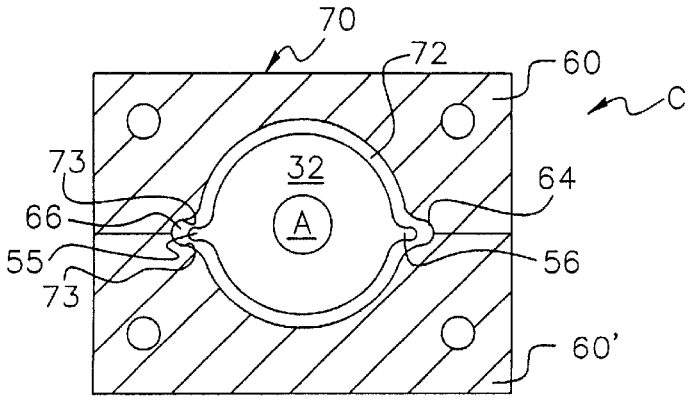

Now in accordance with one aspect of the present invention, each of the drum-support members 32 and 32' of the above-described drum assemblies DA1 and DA2 is further provided with a pair of outwardly extending drum-support legs 55,56 and 55' 56', respectively. These drum-support legs, shown in FIGS. 2A–2D, are adapted to be slidably received by a pair of spaced, parallel guide rails 54, 56 located within the frame of the printer or utilization device for the purpose of guiding a drum to its operative position within the printer. (See FIG. 4) In accordance with a further aspect of the invention, these same drum-support legs (55,56 and 55',56') are also adapted to be slidably received by a similarly spaced and parallel pair of guide channels 64,66 located within a drum container C for the purpose of supporting the drum within the container so that its sensitive outer surface is spaced from all surfaces within the container. Referring to the exploded view of FIG. 3A, a preferred drum-container C of the invention is shown to comprise a pair of mating members 60, 60' that, when moved together so that their respective mating surfaces 60A and 60B are in contact, they collectively define a rectangular box 70 having a cylindrical opening 72 extending therethrough. (See FIG. 3B.) The diameter of cylindrical opening is slightly larger than the diameter of the drum to be contained. Important to note is that a groove 73 is cut along the inside edge of each of the mating surfaces to define the above-mentioned guide channels 64,66 for receiving the drum-support legs 55,56 and 55',56' of the drum support members 32 and 32'. It will be noted that, in FIGS. 3A and 3B, the drum-support members 32 and 34 are illustrated schematically, showing only the essential elements (i.e., drum-support legs 55,56 and 55',56') that interact with the container structure (i.e., guide channels 64,66) for the purpose of supporting the drum inside the container's cylindrical opening 72. In actuality, they are structured as shown in FIGS. 2A–2D. Preferably, the mating halves 60,60' of the container are held together by a pair of end caps 80,82, each having a plurality of outwardly extending pegs P1–P4 that are adapted to engage holes H1–H4 formed in the end walls of the mating members 60,60'. Alternatively, the central portion of the container could be a unitary structure, in which case members 60 and 60' would be merged into one piece, with a spaced pair of elongated parallel groove, extending generally parallel to the drum's central axis (i.e., the drum's axis of rotation), being formed in the container's cylindrical wall for slidably receiving, supporting and guiding the drum-support legs 55,56, and 55' 56'.

Figure 4:
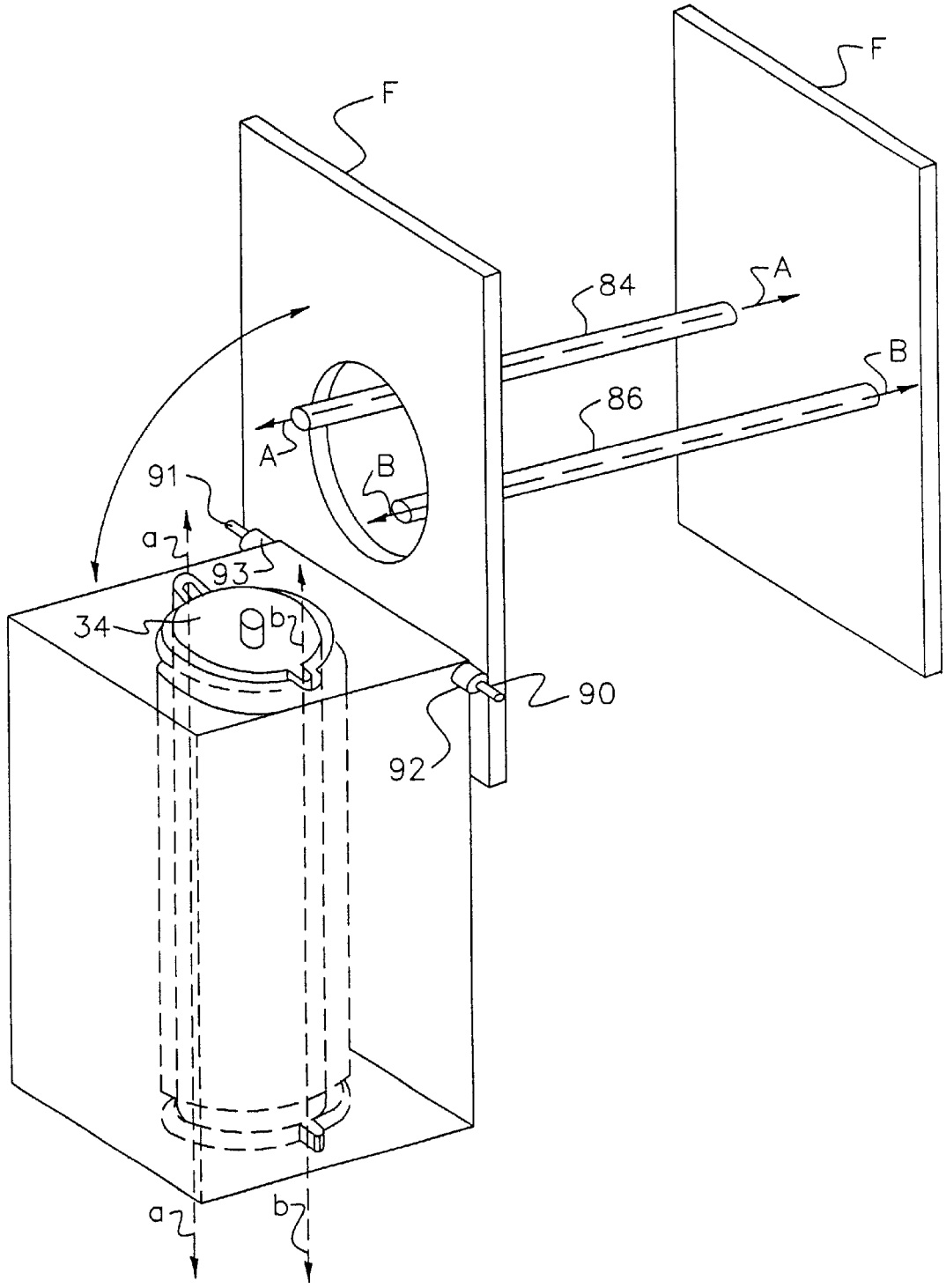
FIG. 4 illustrates the container movably mounted on a printer frame.

According to a preferred embodiment, the central portion of the drum container (end caps removed) is pivotally mounted on the printer frame to facilitate transfer of the drum from the container to the printer. Referring to FIG. 4, an edge of the drum container is provided with a pair of pivot pins 90, 91 which is adapted to be received by a pair of trough-shaped couplers 92,93 fixed to the from wall of the printer frame. The couplers are positioned so that the container can be pivoted from a vertically hanging position to a position in which the respective axes a—a and b—b of the container guide channels are aligned with the respective axes A—A and B—B of the rectilinear guides of the drum-utilization device (printer). In this position, the drum assembly can be readily transferred from said container to the drum-utilization device by sliding the drum-support legs along the container guide channels and into the rectilinear channels of the utilization device until the drum assembly reaches its operative position within the utilization device. Optionally, a clasp or the like can be used to temporarily retain the container in its drum-loading position.

From the foregoing, it will be appreciated that a technically advantageous container has been provided that not only protects the drum surface during shipping and handling, but, optionally serves as a fixture for facilitating the transfer of the drum to a utilization device, such as an electrophotographic printer. Because the drum is guided along a precise rectilinear path during transfer into a printer, those processing stations that operate on the drum surface to produce and transfer images need only be minimally spaced during drum installation or removal to guard against any damage to the drum surface. The drum installer need only align the container guides with the printer guides and push on the drum assembly at one end to effect drum transfer.

Figure 5A:
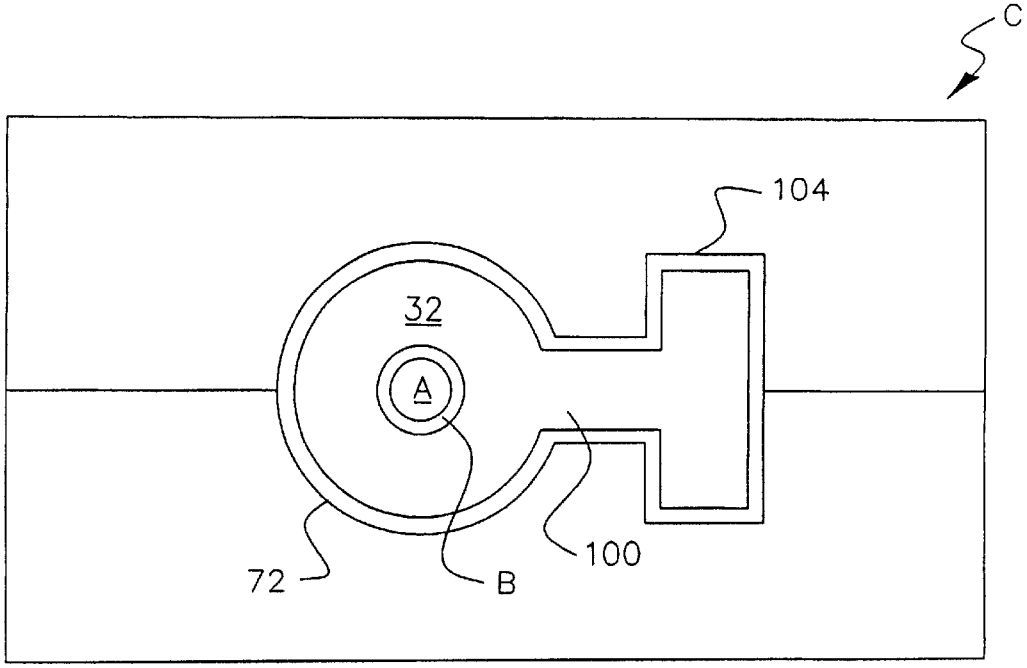
FIGS. 5A and 5B illustrate an alternative embodiment of the invention.
Figure 5B:
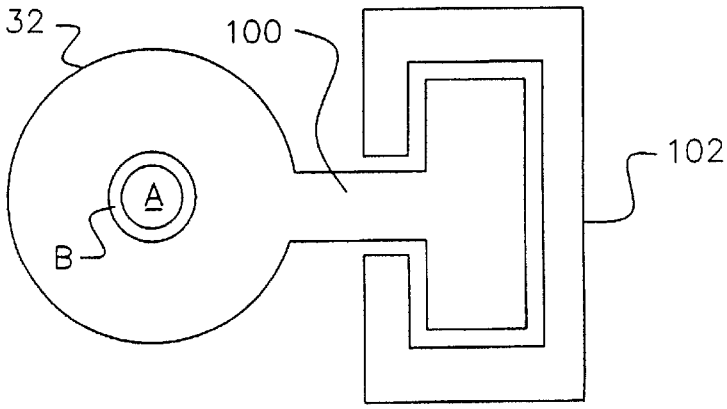

While the invention has been disclosed with reference to the use of a pair of drum-support legs 50,52 being operatively associated with each drum-support member, it will be appreciated that more than two legs can be used to provide support for the drum within the container and utilization device. Each additional drum-support leg will require an additional channel guide for slidably receiving, supporting and guiding it. On the other hand, as shown in FIGS. 5A and 5B, only a single leg need be provided if the leg 100 has, for example, a T-shaped cross-section or the like, and a rectilinear guide 102 and container guide channel 104 of substantially identical cross-section are provided in both the utilization device and container. Other modifications can be made without departing from the spirit of the invention.

PARTS LIST

10—electrophotographic printer
12—image-recording drum
14—corona charging station
16—print head
18—development station
20—first image transfer nip
22—image-transfer drum
23—pre-clean corona charger
24—cleaning brush
26—second image transfer nip
28—pressure roller
30—fusing station
DA1—drum assembly 1
DA2—drum assembly 2
S—image receiving sheet
M—drive motor
F—printer frame
A—drum axles
B—bearings
32,32'—drum support members for drum 12
34,34'—drum support members for drum 22
40,41,40',41'—reference features on drum support members 32,32' for positioning charging station 14
43, 43'—reference features on drum supports 32,32' for positioning development station
44,44'—reference features on drum support members 32,32' for positioning image-transfer drum 22
46,46'—reference features on drum support members 32,32' for positioning pre-clean corona charger 23
48,48'—reference feature on drum support members 32.32' for positioning cleaning brush 24
50,50'—reference features on corona charger 14
54,54'—reference features on transfer drum support members
55,55';56,56'—drum support legs carried by drum support members 32,32'
C—drum container
60,60'—mating container members
60A,60B, —mating surfaces on container members
64,66—container guide channels
70—box
72—cylindrical opening
73—guide-channel-defining grooves
80,82—container end caps
P1–P4—connector pegs
H1–H4—peg holes
84,86—rectilinear guides in printer
A—A—Axis of printer guide 84
B—B—Axis of printer guide 86
a—a—Axis of container guide channel 64
b—b—Axis of container guide channel 66
90, 91—mounting pivot pins on container
92,93—trough-shaped couplers for pivot pins mounted on printer frame
100—drum-support leg
102—rectilinear guide in printer
104—container guide channel

What is claimed is:

1. A protective container for a drum assembly of the type that includes (i) a drum having a pair of axles extending outwardly from opposing ends of the drum along a desired axis of rotation and (ii) a pair of spaced drum-support members that rotatably support the drum therebetween, each drum-support member including a bearing located in a central region thereof for rotatably supporting one of said drum axles, and at least one outwardly extending drum-support leg adapted to slidably engage an elongated, rectilinear guide within a drum-utilization device for guiding said drum assembly to a desired operative position within a frame of said drum-utilization device, said protective container comprising:

(a) a frame for housing said drum assembly; and (b) at least one rectilinear guide member mounted within said frame and defining a container guide channel adapted to receive the respective drum-support legs of said drum-support members and to slidably support said drum assembly within said container so that the drum's outer surface is out of contact with any surface of said container.

2. The protective enclosure as defined by claim 1 further comprising (c) mounting means for mounting said frame on said drum-utilization device in a position in which said container guide channel is aligned and in communication with the rectilinear guide of said drum-utilization device, whereby said drum assembly can be transferred from said container to said drum-utilization device by sliding said drum support legs along said container guide channel and into said rectilinear guide of said utilization device.

3. The protective enclosure as defined by claim 2 wherein said mounting means comprises means for movably mounting said container frame on said drum-utilization device for movement between a standby position in which said container guide channel and said device guide are non-aligned, and a drum-loading position in which said container guide channel is aligned and in communication with said device guide.

4. The protective enclosure as defined by claim 3 wherein said mounting means comprises means for pivotally mounting said container frame on said drum-utilization device.

5. The protective enclosure as defined by claim 1 wherein each of said drum-support members comprises a plurality of outwardly extending drum-support legs adapted to slidably engage a like plurality of elongated rectilinear guides extending substantially parallel to each other within said drum-utilization device for guiding said drum assembly to a desired operative position within a frame of said drum-utilization device, and wherein said enclosure comprises a like plurality of spaced rectilinear guide channels adapted to collectively receive the drum-support legs of said drum-support member and to slidably support said drum assembly within said container, said plurality of spaced rectilinear guide members within said container being arranged to communicate with the plurality of elongated rectilinear guides within said utilization device when said container frame is mounted on said utilization device.

6. A system for transferring an image-recording drum from a container to an operative position within in a printer/copier, said system comprising:

(a) first support means for slidably supporting an image-recording drum for movement along a first rectilinear path within a drum container;

(b) second support means for slidably supporting an image-recording drum for movement along a second rectilinear path within a printer/copier frame between a drum-receiving position and an operative position; and (c) means for selectively mounting the container on the printer/copier so that the first and second rectilinear paths are in communicative alignment, whereby the drum is slidably transferable from the drum container to said operative position in the printer/copier.

7. A method for installing an image-recording drum into an operative position within a printer/copier comprises the steps of:

(a) providing a drum container of the type comprising at least one rectilinear guide for supporting a drum for sliding movement within the container in a direction substantially parallel to the drum's axis of rotation;

(b) slidably mounting an image-recording drum within said container in said rectilinear guide;

(c) providing at least one rectilinear drum guide within a printer/copier for slidably supporting a drum for rectilinear movement towards and away from an operative position;

(d) positioning the drum container relative to the printer/copier so that their respective rectilinear guides are aligned and communicate; and (e) sliding the drum along the container's rectilinear guide and into the rectilinear guide of the printer/copier.

* * * * *